US011499426B2

(12) United States Patent
de Sousa et al.

(10) Patent No.: US 11,499,426 B2
(45) **Date of Patent: *Nov. 15, 2022**

(54) CUTTING DEVICE WITH TAPERED CUTTING ELEMENT

(71) Applicant: Joy Global Underground Mining LLC, Warrendale, PA (US)

(72) Inventors: Joaquim Antonio Soares de Sousa, Alberton (CA); Michael Laing, Alberton (CA)

(73) Assignee: JOY GLOBAL UNDERGROUND MINING LLC, Warrendale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/072,351

(22) Filed: Oct. 16, 2020

(65) Prior Publication Data

US 2021/0032989 A1 Feb. 4, 2021

Related U.S. Application Data

(63) Continuation of application No. 15/606,696, filed on May 26, 2017, now Pat. No. 10,808,531.
(Continued)

(51) Int. Cl.
*E21C 35/00* (2006.01)
*E21C 27/20* (2006.01)
(Continued)

(52) U.S. Cl.
CPC ..... *E21C 27/20* (2013.01); *E21C 35/1837* (2020.05); *E21D 9/102* (2013.01);
(Continued)

(58) Field of Classification Search
CPC ..... E21C 25/18; E21C 35/1837; E21C 25/06; E21C 27/02; E21C 27/16; E21C 31/02; E21D 9/1013
See application file for complete search history.

(56) References Cited

U.S. PATENT DOCUMENTS 2,121,202 A 6/1938 Killgore
2,763,258 A 9/1956 Hughes
(Continued)

FOREIGN PATENT DOCUMENTS

AU 2015203867 A1 7/2015
CL 199500435 2/1996
(Continued)

OTHER PUBLICATIONS

Russian Federal Service for Intellectual Property Decision of Grant for Application No. 2018144221 dated Jun. 10, 2021 (24 pages including English translation).
(Continued)

*Primary Examiner* — Janine M Kreck
(74) *Attorney, Agent, or Firm* — Michael Best & Friedrich LLP

(57) ABSTRACT

A cutting device for cutting rock includes a disc and a plurality of cutting elements secured to the disc. The disc is supported for rotation about an axis of rotation, and the disc includes a peripheral edge extending around the axis of rotation. The plurality of cutting elements are spaced apart along the peripheral edge of the disc and positioned in a cutting plane. Each of the cutting elements includes a base portion and a cutting portion including a cutting edge, and the cutting portion has a width that is larger than a width of the base portion.

22 Claims, 14 Drawing Sheets

Related U.S. Application Data

(60) Provisional application No. 62/446,799, filed on Jan. 16, 2017, provisional application No. 62/342,254, filed on May 27, 2016, provisional application No. 62/342,438, filed on May 27, 2016.

(51) Int. Cl.

| | |
|---|---|
| ***E21C 35/183*** | (2006.01) |
| ***E21D 9/10*** | (2006.01) |
| *E21C 27/02* | (2006.01) |
| *E02F 9/28* | (2006.01) |
| *E02F 5/18* | (2006.01) |
| *B26D 1/00* | (2006.01) |
| *E21B 3/02* | (2006.01) |
| *E21C 25/06* | (2006.01) |
| *E21C 25/18* | (2006.01) |
| *E21C 27/16* | (2006.01) |
| *E21C 31/02* | (2006.01) |
| *E02F 5/20* | (2006.01) |
| *E21B 3/03* | (2006.01) |

(52) U.S. Cl.

CPC ..... *B26D 2001/0046* (2013.01); *E02F 5/18* (2013.01); *E02F 5/20* (2013.01); *E02F 9/2866* (2013.01); *E21B 3/02* (2013.01); *E21B 3/03* (2013.01); *E21C 25/06* (2013.01); *E21C 25/18* (2013.01); *E21C 27/02* (2013.01); *E21C 27/16* (2013.01); *E21C 31/02* (2013.01); *E21D 9/1013* (2013.01)

(56) References Cited

U.S. PATENT DOCUMENTS

| | | | | |
|---|---|---|---|---|
| 3,048,160 | A | 8/1962 | Griffin et al. | |
| 3,411,826 | A | 11/1968 | Wallers et al. | |
| 3,442,342 | A | 5/1969 | McElya et al. | |
| 3,461,983 | A | 8/1969 | Hudson et al. | |
| 3,536,150 | A | 10/1970 | Stebley | |
| 3,633,637 | A | 1/1972 | Kolesh | |
| 3,647,265 | A | 3/1972 | Pentith | |
| 3,952,815 | A | 4/1976 | Dysart | |
| 3,957,307 | A * | 5/1976 | Varda | B28D 1/188 299/106 |
| 4,004,645 | A | 1/1977 | Rees et al. | |
| 4,109,737 | A | 8/1978 | Bovenkerk | |
| 4,148,368 | A | 4/1979 | Evans | |
| 4,202,419 | A | 5/1980 | Youngblood | |
| 4,231,438 | A | 11/1980 | Garner et al. | |
| 4,466,498 | A | 8/1984 | Bardwell | |
| 4,499,958 | A | 2/1985 | Radtke et al. | |
| 4,527,941 | A | 7/1985 | Klemm | |
| 4,751,972 | A | 6/1988 | Jones et al. | |
| 4,753,305 | A | 6/1988 | Fisher | |
| 4,755,004 | A * | 7/1988 | Palmquist | B28D 1/122 299/106 |
| 4,838,366 | A | 6/1989 | Jones | |
| 5,060,735 | A | 10/1991 | Agren | |
| 5,129,296 | A | 7/1992 | Wayne | |
| 5,139,099 | A | 8/1992 | Hayashi et al. | |
| 5,143,163 | A | 9/1992 | Stiffler et al. | |
| 5,291,807 | A | 3/1994 | Vanderford et al. | |
| 5,497,843 | A * | 3/1996 | Burns | E21B 10/44 175/403 |
| 5,518,443 | A | 5/1996 | Fisher | |
| 5,551,760 | A | 9/1996 | Sollami | |
| 5,722,497 | A | 3/1998 | Gum et al. | |
| 5,884,979 | A | 3/1999 | Latham | |
| 6,019,434 | A * | 2/2000 | Emmerich | E21C 35/183 299/111 |
| 6,145,605 | A | 11/2000 | Karlsson | |
| 6,260,637 | B1 | 7/2001 | Haussmann et al. | |
| 6,290,008 | B1 | 9/2001 | Portwood et al. | |
| 6,343,842 | B1 * | 2/2002 | Sauer | E21B 10/10 175/373 |
| 6,367,569 | B1 | 4/2002 | Walk | |
| 6,561,590 | B2 * | 5/2003 | Sugden | E21D 9/102 299/71 |
| 6,692,083 | B2 | 2/2004 | Latham | |
| 6,766,870 | B2 | 7/2004 | Overstreet | |
| 7,182,407 | B1 | 2/2007 | Peach et al. | |
| 7,240,746 | B2 | 7/2007 | Overstreet et al. | |
| 7,338,135 | B1 | 3/2008 | Hall et al. | |
| 7,389,833 | B2 | 6/2008 | Walker et al. | |
| 7,401,537 | B1 | 7/2008 | Krauter | |
| 7,770,664 | B2 | 8/2010 | Laird et al. | |
| 3,007,049 | A1 | 8/2011 | Fader et al. | |
| 8,016,056 | B2 | 9/2011 | Viswanadham et al. | |
| 8,522,899 | B2 | 9/2013 | Bouaphanh | |
| 8,523,288 | B2 | 9/2013 | Hanaoka et al. | |
| 8,777,326 | B2 | 7/2014 | Hall | |
| 9,062,502 | B2 | 6/2015 | King | |
| 9,803,476 | B2 | 10/2017 | Raschka et al. | |
| 10,808,531 | B2 * | 10/2020 | de Sousa | E21D 9/102 |
| 2002/0093239 | A1 | 7/2002 | Sugden | |
| 2006/0061206 | A1 | 3/2006 | Nava | |
| 2008/0036279 | A1 | 2/2008 | Hall et al. | |
| 2009/0322143 | A1 | 12/2009 | Krauter | |
| 2010/0018514 | A1 | 1/2010 | Wills, II | |
| 2010/0104382 | A1 | 4/2010 | Heinloth | |
| 2012/0198671 | A1 | 8/2012 | Meidar et al. | |
| 2013/0014999 | A1 | 1/2013 | King | |
| 2013/0181501 | A1 | 7/2013 | Hall et al. | |
| 2014/0251696 | A1 | 9/2014 | Cox | |
| 2015/0030397 | A1 | 1/2015 | Heinloth | |
| 2017/0342829 | A1 | 11/2017 | de Sousa et al. | |
| 2017/0342830 | A1 | 11/2017 | de Sousa et al. | |
| 2017/0342835 | A1 | 11/2017 | de Sousa et al. | |

FOREIGN PATENT DOCUMENTS

| | | | |
|---|---|---|---|
| CN | 2623865 | Y | 7/2004 |
| CN | 201198737 | Y | 2/2009 |
| CN | 201771431 | U | 3/2011 |
| CN | 102777173 | A | 11/2012 |
| CN | 204782795 | U | 11/2015 |
| EP | 1481782 | A1 | 12/2004 |
| GB | 1479374 | A | 7/1977 |
| JP | S57100288 | A | 6/1982 |
| JP | H11223090 | A | 8/1999 |
| JP | 2007169947 | A | 7/2007 |
| RU | 2018659 | C1 | 8/1994 |
| RU | 2436952 | C1 | 12/2011 |
| RU | 2522607 | C2 | 7/2014 |
| RU | 2571471 | C2 | 12/2015 |
| SU | 220292 | A1 | 9/1968 |
| SU | 443171 | A1 | 9/1974 |
| SU | 937717 | A1 | 6/1982 |
| SU | 1416684 | A2 | 8/1988 |
| WO | 03001031 | A1 | 1/2003 |

OTHER PUBLICATIONS

International Search Report and Written Opinion for Application No. PCT/US2017/034738 dated Aug. 25, 2017 (15 pages).

International Search Report and Written Opinion for Application No. PCT/US2017/034729 dated Aug. 25, 2017 (15 pages).

International Search Report and Written Opinion for Application No. PCT/US2017/034713 dated Aug. 25, 2017 (13 pages).

Extended European Search Report for Application No. 17803684.4 dated Mar. 20, 2020 (8 pages).

Office Action issued by the Federal Institute of Industrial Property for Application No. 2018144221/03 dated May 27, 2020 (14 pages including English translation).

Office Action issued by the China National Intellectual Property Administration for Application No. 201780041479.5 dated Sep. 24, 2020 (10 pages including English summary).

Office Action issued by the Federal Institute of Industrial Property for Application No. 2018144221 dated Oct. 23, 2020 (11 pages including English translation).

(56) References Cited

OTHER PUBLICATIONS

Office Action issued by the Canadian Intellectual Property Office for Application No. 3025632 dated Mar. 1, 2022 (3 pages).
Office Action issue by IP Australia for Application No. 2017269407 dated Apr. 11, 2022 (4 pages).
Chinese Patent Office Action and Written Opinion for Application No. 201780041479.5 dated Nov. 26, 2021 (10 pages, including English Summary).
European Patent Office Action for Application No. 17803684.4 dated Jun. 27, 2022 (3 pages).

* cited by examiner

CUTTING DEVICE WITH TAPERED CUTTING ELEMENT

CROSS-REFERENCE TO RELATED APPLICATIONS

This application is a continuation of U.S. patent application Ser. No. 15/606,696, filed May 26, 2017, which claims the benefit of U.S. Provisional Application No. 62/342,438, filed May 27, 2016, U.S. Provisional Application No. 62/342,254, filed May 27, 2016, and U.S. Provisional Patent Application No. 62/446,799, filed Jan. 16, 2017. The entire contents of these documents are incorporated by reference herein.

BACKGROUND

The present invention relates to machines for mining or excavation, and more particularly to cutting devices for a machine for mining or excavation.

Mining machines may include rotating cutting discs to engage rock formations and walls cut or dislodge rock and/or mineral. The cutting disc may be rotated and driven to undercut the rock face at a narrow angle relative to the plane of the face, generating shear forces to cause the rock to fracture. Each cutting disc has a plurality of bits or buttons.

SUMMARY

In one aspect, a cutting device for cutting rock includes a disc and a plurality of cutting elements secured to the disc. The disc is supported for rotation about an axis of rotation, and the disc includes a peripheral edge extending around the axis of rotation. The plurality of cutting elements are spaced apart along the peripheral edge of the disc and positioned in a cutting plane. Each of the cutting elements includes a base portion and a cutting portion including a cutting edge, and the cutting portion has a width that is larger than a width of the base portion.

In another aspect, a cutting head for a mining machine includes a boom configured to be supported on a frame, a drive mechanism, and a cutting device supported on the boom and driven by the drive mechanism. The cutting device includes a disc and a plurality of cutting elements secured to the disc. The disc is supported for rotation about an axis of rotation, and the disc includes a peripheral edge extending around the axis of rotation. The plurality of cutting elements are spaced apart along the peripheral edge of the disc and positioned in a cutting plane. Each of the cutting elements includes a base portion and a cutting portion including a cutting edge. The cutting portion has a width that is larger than a width of the base portion.

Other features and aspects will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

DETAILED DESCRIPTION

Figure 1:
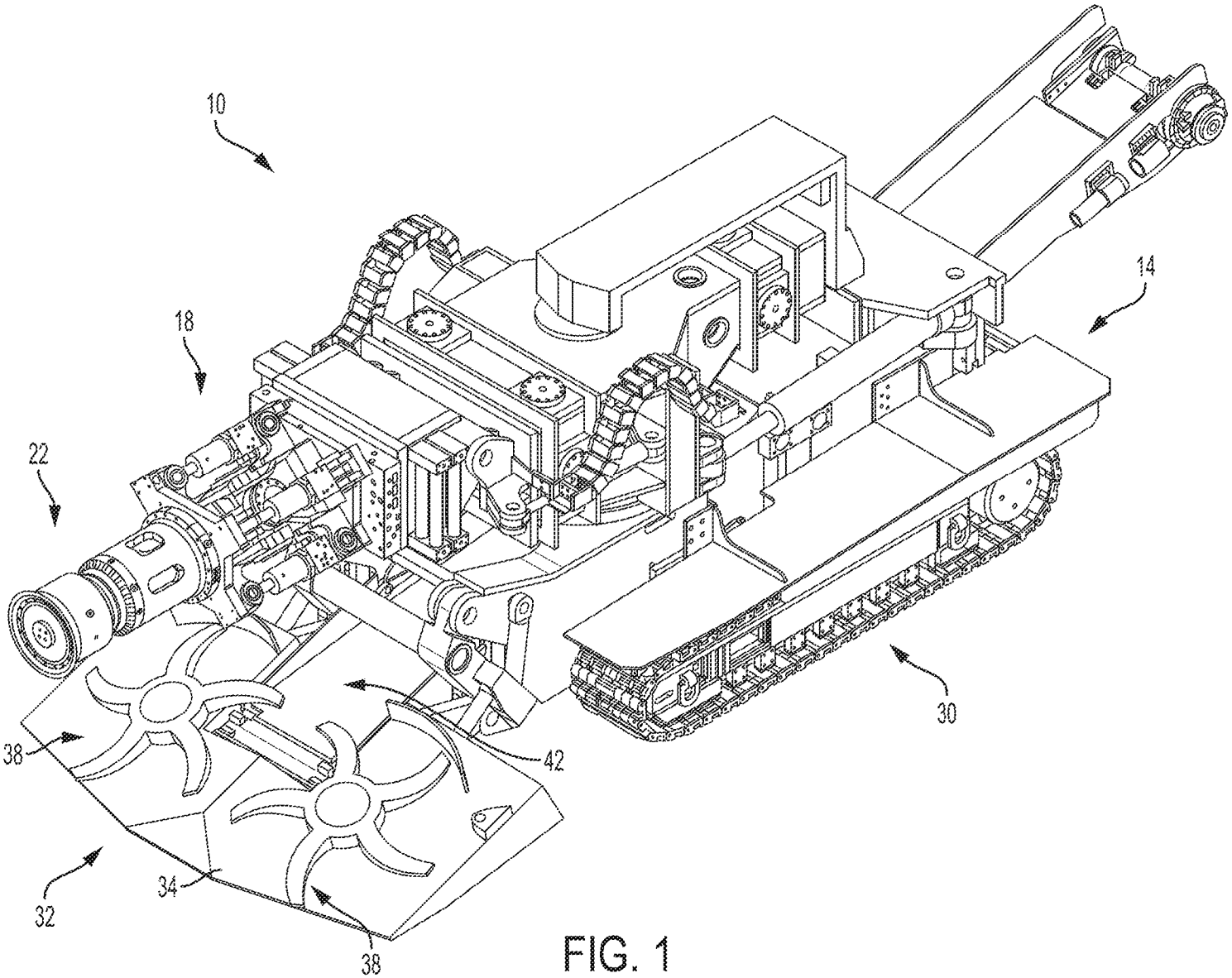
FIG. 1 is a perspective view of a mining machine.

FIG. 1 illustrates an exemplary mining machine 10 including a frame 14, a boom 18, and a cutting head 22 supported on the boom 18 for engaging a mine wall. The frame 14 includes a drive system including traction devices, such as tracks 30, for moving the frame 14 over a support surface or mine floor. In the illustrated embodiment, the frame 14 further includes a gathering head 32 positioned adjacent the mine floor proximate the cutting head 22. The gathering head 32 includes a deck 34 and rotating members 38 that direct cut material from the deck 34 onto a conveyor 42. In some embodiments, the frame 14 may also include arms for directing cut material onto the deck 34. In the illustrated embodiment, the mining machine 10 includes a single cutting head; in other embodiments, the machine 10 may include multiple cutting heads.

Figure 2:
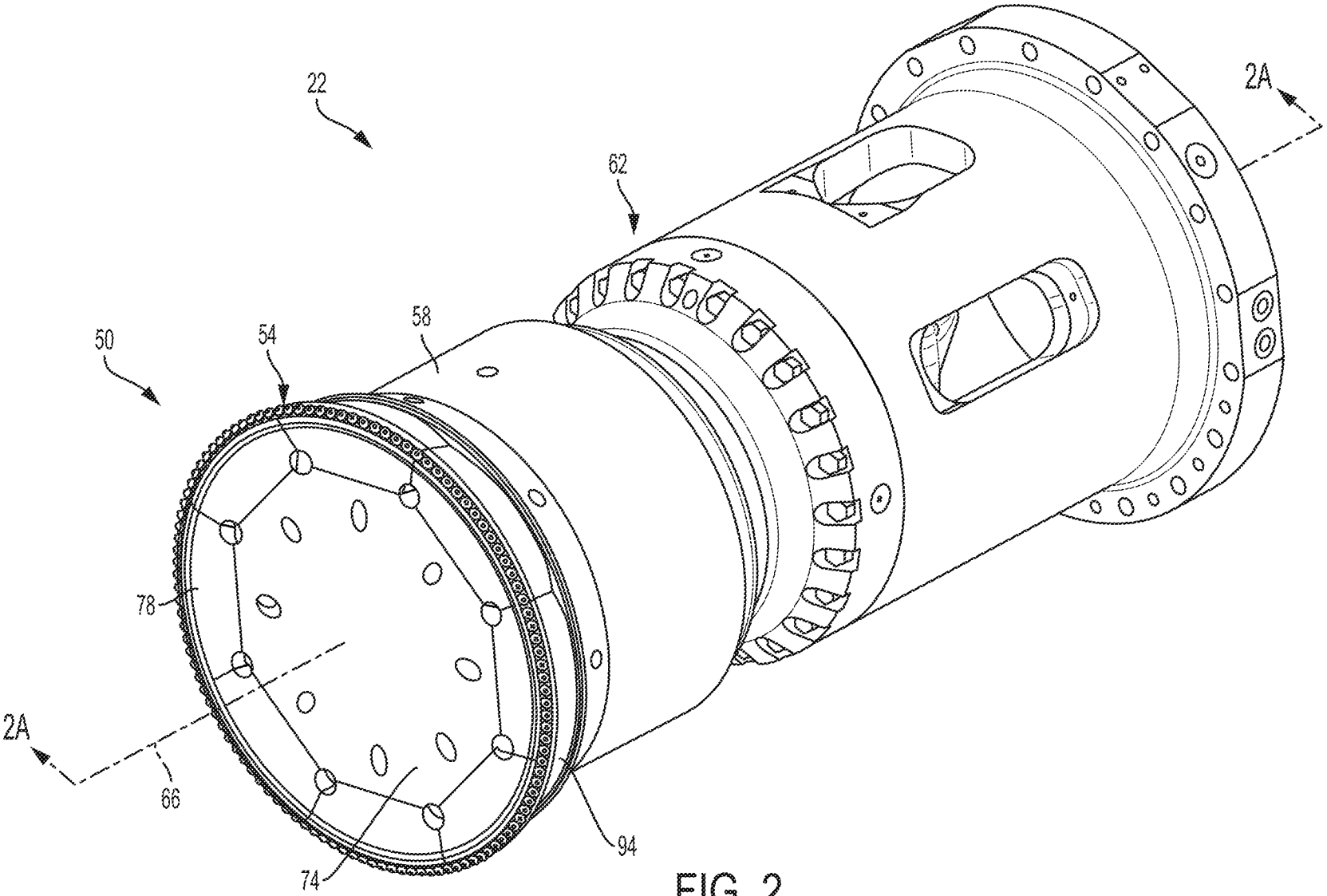
FIG. 2 is a perspective view of a cutting head.
Figure 2A:
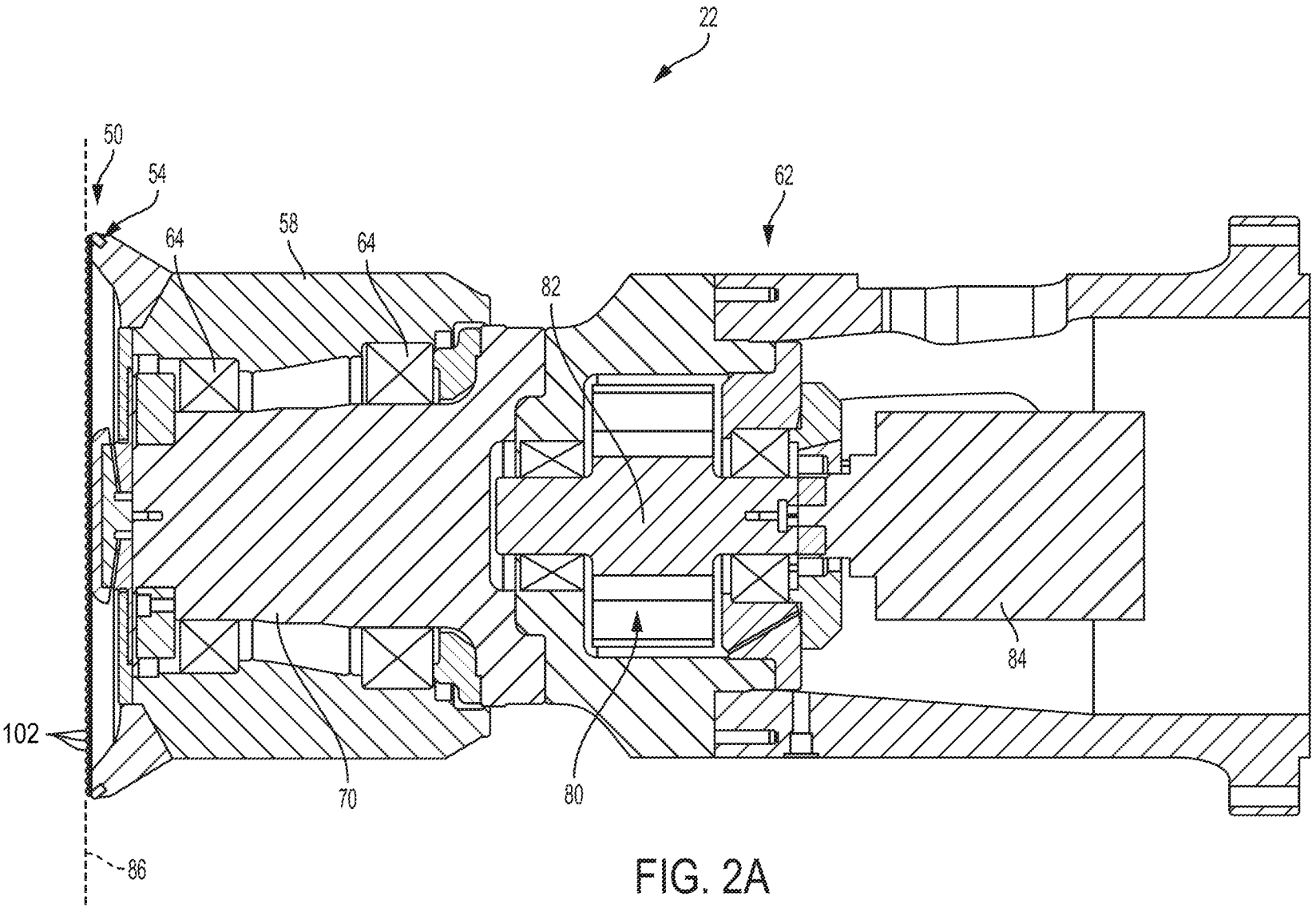
FIG. 2A is a cross-sectional view of the cutting head of FIG. 2, viewed along section 2A-2A.

As shown in FIG. 2, the cutting head 22 includes a cutting disc 50 having an outer edge or peripheral edge 54, and the cutting disc 50 engages a mine wall (not shown) to remove rock from the wall. In the illustrated embodiment, the cutting head 22 further includes a carrier 58 and an arm 62. The disc 50 is coupled to the carrier 58, which is supported for rotation (e.g., by bearings 64—FIG. 2A) relative to the arm 62 about an axis of rotation 66. In the illustrated embodiment, the cutting disc 50 and/or carrier 58 are freely rotatable relative to the arm 62. As shown in FIG. 2A, in the illustrated embodiment, the arm 62 includes a shaft 70 supporting the carrier 58, and the cutting head 22 further includes an exciter assembly for inducing oscillation of the cutting head 22. The exciter assembly includes an eccentric exciter mass 80 coupled to a shaft 82 and supported for rotation on the arm 62, and a motor 84 for mechanically driving the exciter mass 80 to rotate. Rotation of the exciter mass 80 causes the cutting head 22 (including the cutting disc 50) to oscillate.

In some embodiments, the cutting head and disc may operate in a manner similar to that of the mining machine disclosed in U.S. Patent Application Publication No. 2014/0077578, filed Sep. 16, 2013, the entire contents of which are incorporated by reference herein. In other embodiments, the cutting head and disc operates in a similar manner to the cutting mechanism disclosed in U.S. Pat. No. 7,934,776, published May 3, 2011, the entire contents of which are incorporated by reference herein. In other embodiments, the cutting disc may be is driven to rotate in another manner.

Figure 3:
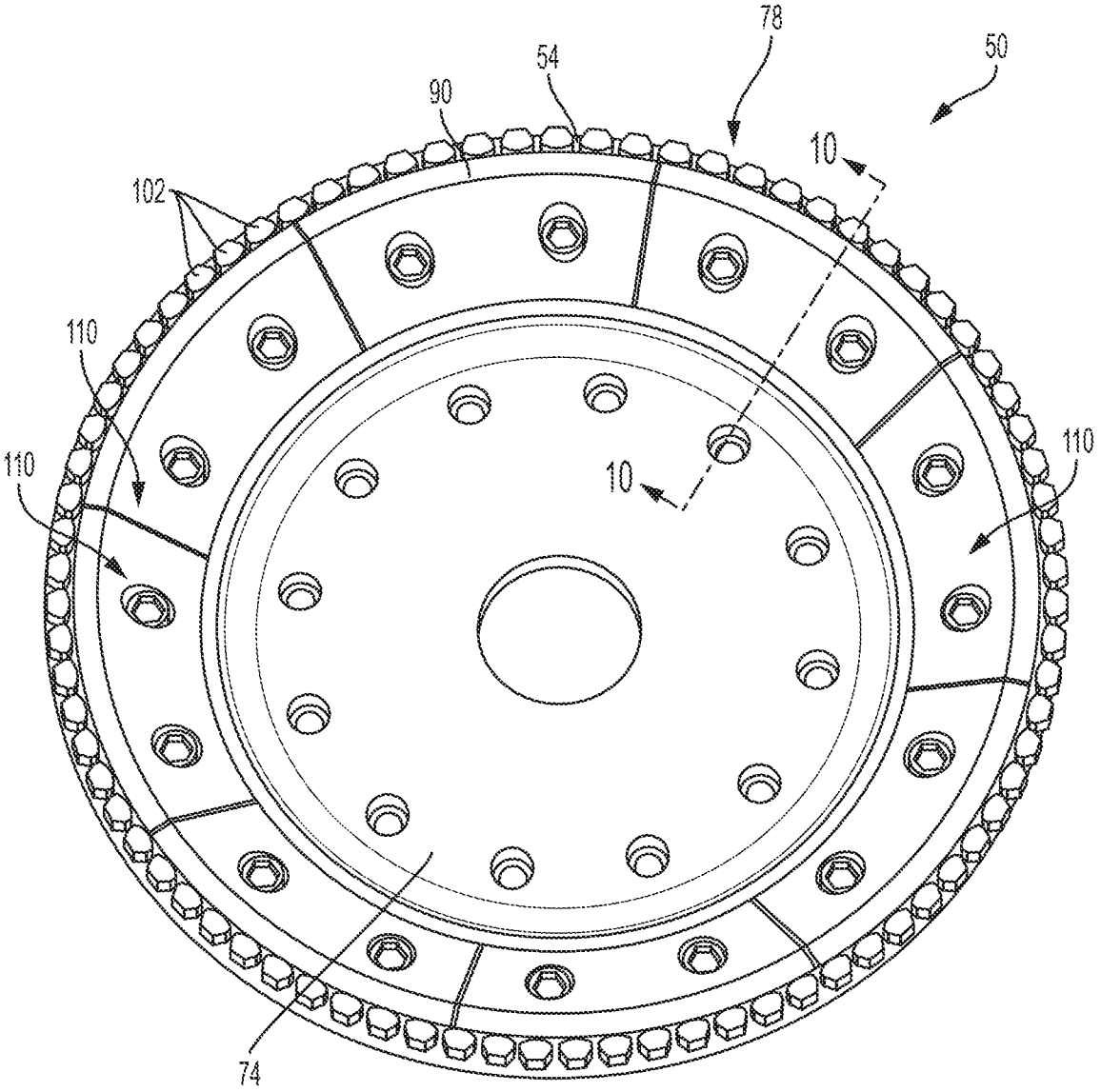
FIG. 3 is a plan view of a cutting disc.

As shown in FIGS. 2 and 3, the cutting disc 50 includes a main support 74 secured to the carrier 58, and a cutting ring 78 extending around the main support 74. The cutting ring 78 forms the peripheral edge 54 positioned within a plane 86 (FIG. 2A). In the illustrated embodiment, the peripheral edge 54 is formed at a junction between an end surface 90 (FIG. 3) of the cutting ring 78 (e.g., a distal end of the disc 50) and an outer lateral surface or peripheral surface 94 of the cutting ring 78. In some embodiments, the plane 86 is coplanar with the end surface 90 of the cutting ring 78 and is perpendicular to the axis of rotation 66 (FIG. 2) of the cutting disc 50. The peripheral surface 94 may have a substantially cylindrical or frustoconical shape, and may extend around the axis of rotation 66.

Figure 4:
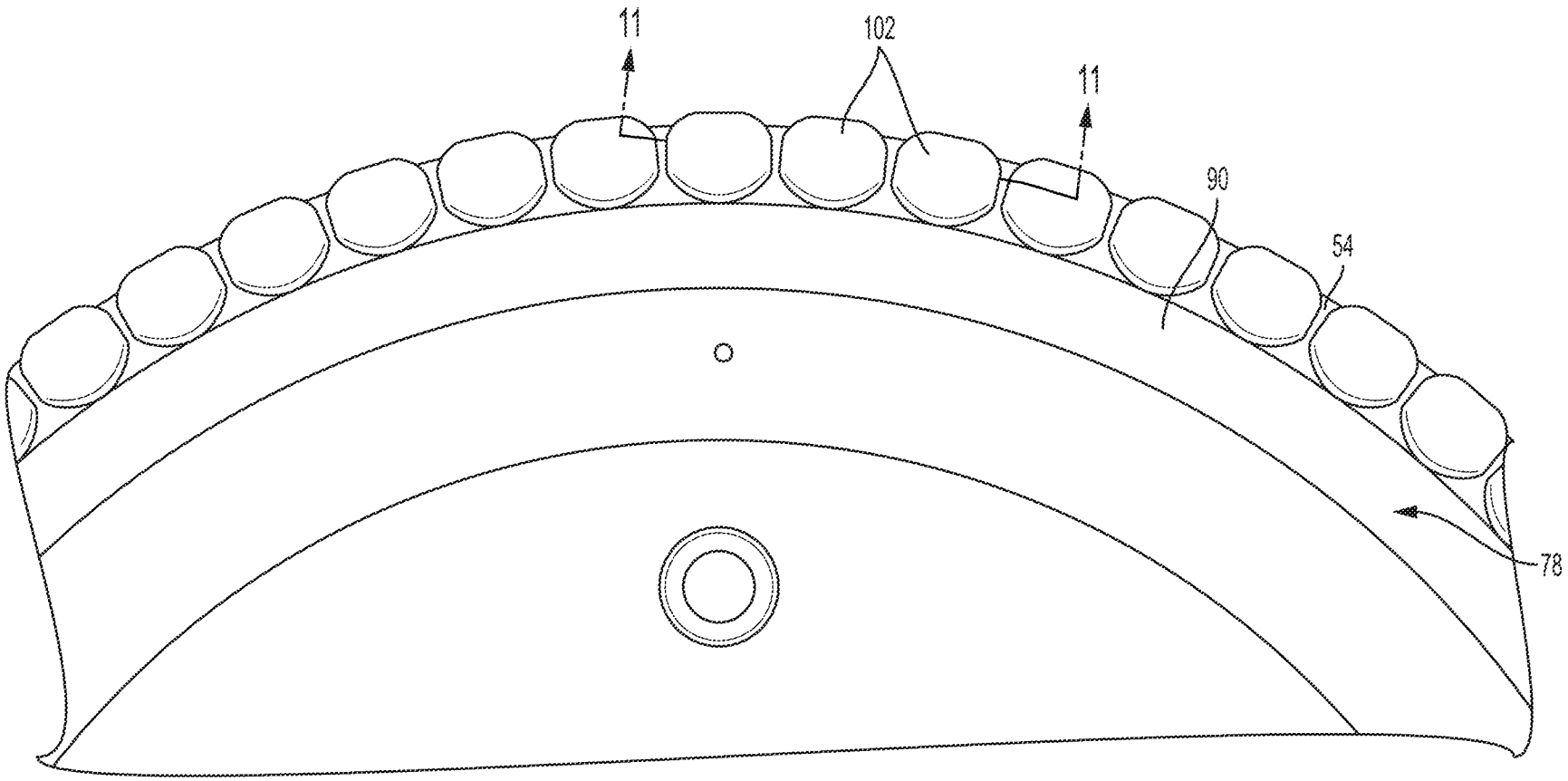
FIG. 4 is an enlarged plan view of a portion of the cutting disc of FIG. 3.

As shown in FIGS. 3 and 4, a plurality of cutting elements or cutting buttons or cutting bits 102 are positioned along the peripheral edge 54 and spaced apart from one another (e.g., at regular intervals). In the illustrated embodiment, the peripheral edge 54 includes a plurality of bores 106 (FIG. 10), and each of the cutting bits 102 is positioned within an associated bore 106. The main support 74 and/or the cutting ring 78 can be formed from rigid materials (e.g., steel and/or other metals), and the cutting bits 102 can be constructed from a material having high hardness (e.g., carbide).

Referring to FIG. 3, in the illustrated embodiment, the cutting ring 78 may be formed as a plurality of radial cutting sections 110 independently and removably coupled to the main support 74 (e.g., by fasteners, quick release connections, etc.). Each of the cutting sections 110 supports some of the cutting bits 102. In the illustrated embodiment, the cutting sections 110 are coupled to the main support 74 and positioned around the axis of rotation 66 (FIG. 2), thereby defining a circular or round profile. In other embodiments, the cutting sections 110 may be positioned in a different manner. The detachable aspect of the cutting sections 110 provides a modular cutting disc 50, allowing worn or degraded cutting sections 110 to be replaced individually without the need to replace the entire disc, reducing downtime due to maintenance. In other embodiments, however, the cutting ring 78 may be formed as a single unitary member supporting the cutting bits 102.

Figure 5:
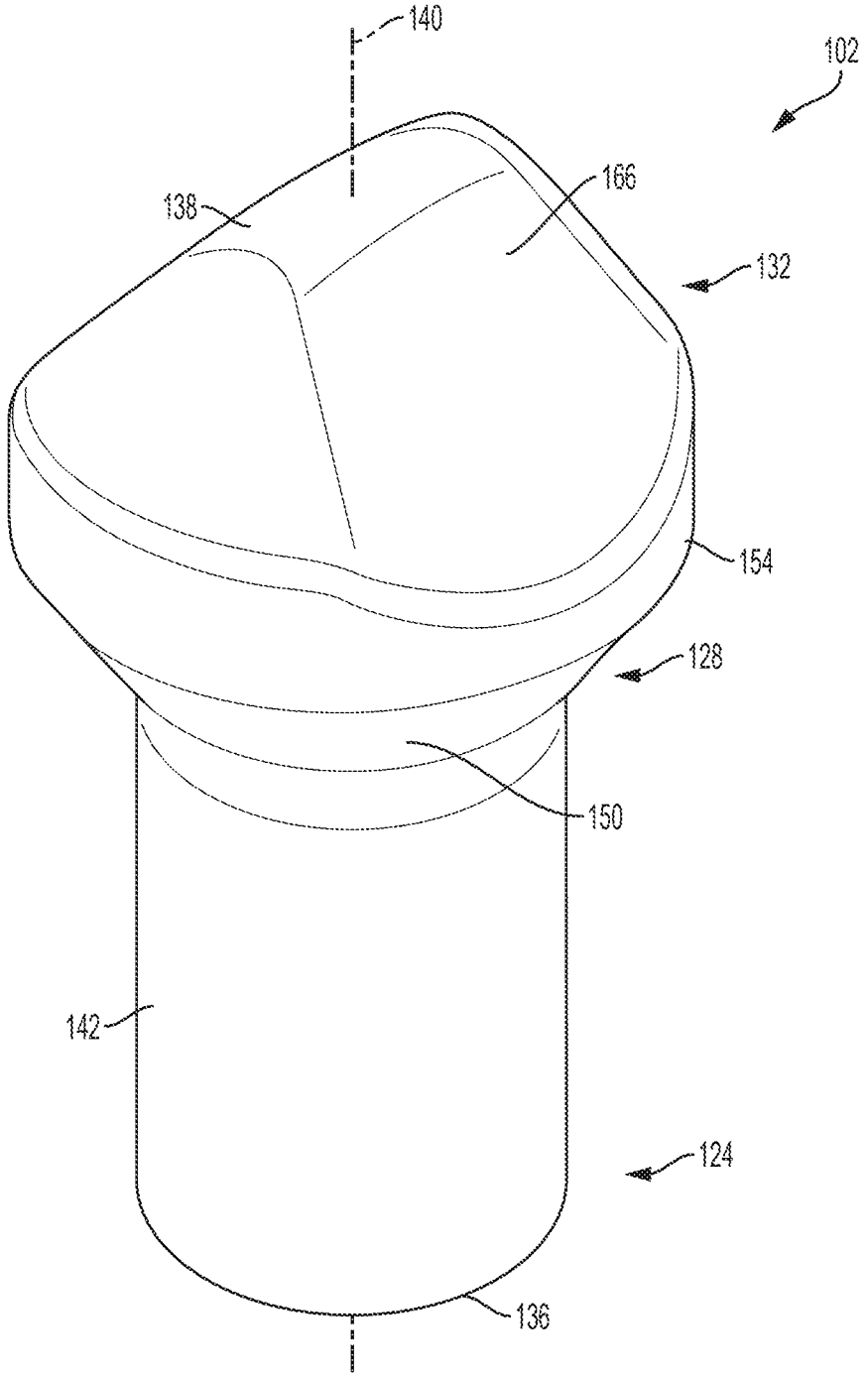
FIG. 5 is a perspective view of a cutting bit.
Figure 6:
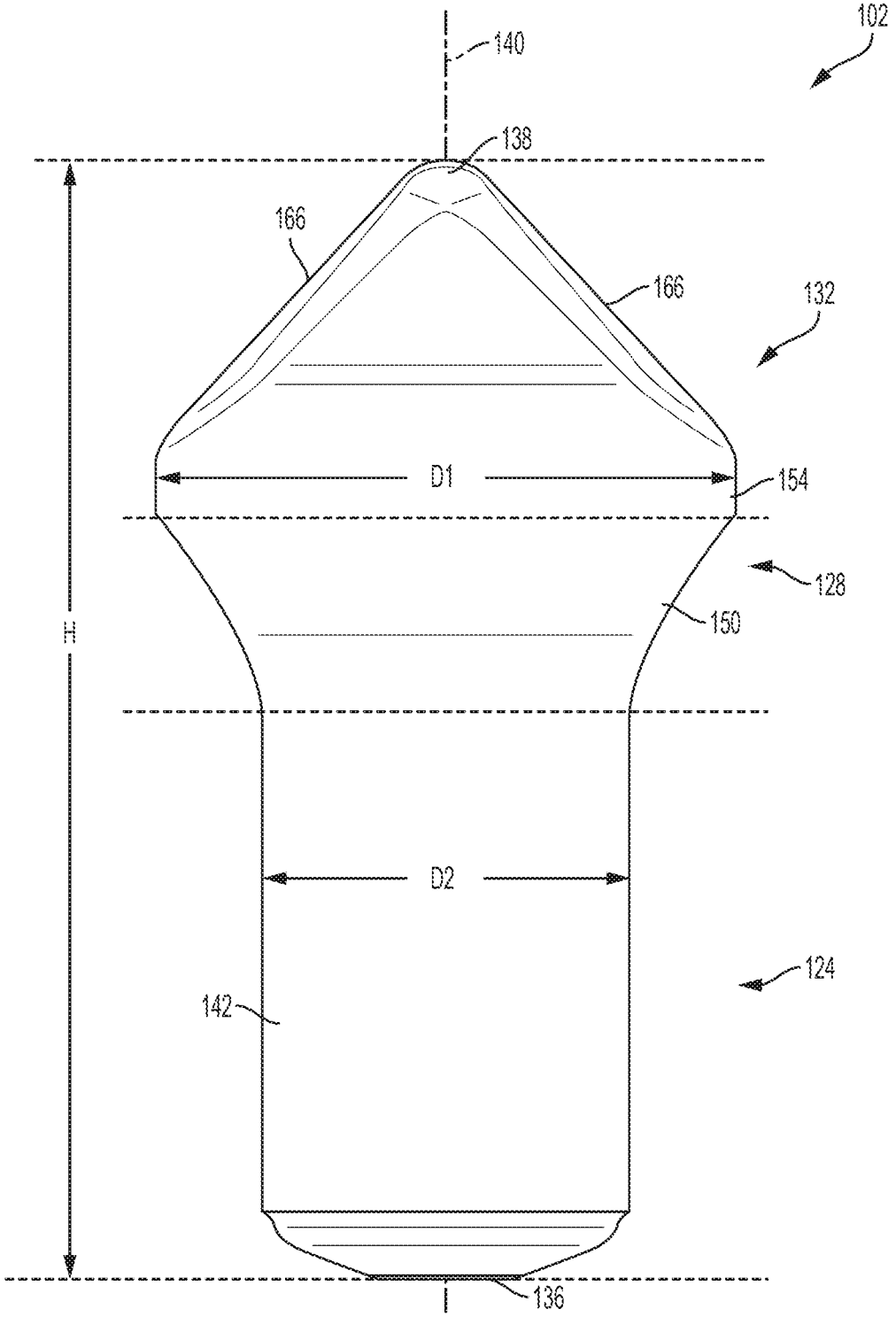
FIG. 6 is a first side view of the cutting bit of FIG. 5.

As shown in FIGS. 5 and 6, each cutting bit 102 includes a first portion or base portion 124, a second portion or transition portion 128, and a third portion or cutting portion 132. The base portion 124 includes a base end 136 defining a first end of the cutting bit 102, and the cutting portion 132 includes a cutting tip or cutting edge 138 defining a second end of the cutting bit 102. A longitudinal axis 140 extends between the base end 136 and the cutting edge 138. In the illustrated embodiment, the base portion 124 has a cylindrical shape. The cumulative height of the base portion 124, the transition portion 128, and the cutting portion 132 defines a height H (FIG. 6). In some embodiments, the height H is between approximately 20 mm and approximately 40 mm. In some embodiments, the height H is between approximately 25 mm and approximately 35 mm. In some embodiments, the height H is approximately 31 mm.

The base portion 124 is positioned within an associated bore 106 (FIG. 10) of the cutting ring 78. The base portion 124 includes an outer surface 142 having a width D2. The outer surface 142 is contiguous with a tapered base end 136 and the transition portion 128. The transition portion 128 includes a tapered or inclined surface 150 extending outwardly from the outer surface 142 of the base portion 124. The inclined surface 150 is contiguous with the base portion 124 and a shoulder 154. The shoulder 154 has a width D1 that is wider than the width D2 of the outer surface 142.

In the illustrated embodiment, the outer surface 142 and the shoulder 154 both have a circular profile, and the widths D1 and D2 represent diameters of the respective portions. In some embodiments, the shoulder 154 has a diameter D1 between approximately 12 mm and approximately 20 mm. In some embodiments, the shoulder 154 has a diameter D1 of approximately 16 mm. In some embodiments, the outer surface 142 has a diameter D2 between approximately 7 mm and approximately 13 mm. In some embodiments, the outer surface 142 has a diameter D2 of approximately 10 mm. In other constructions, one or more of these widths may have different dimensions.

Figure 7:
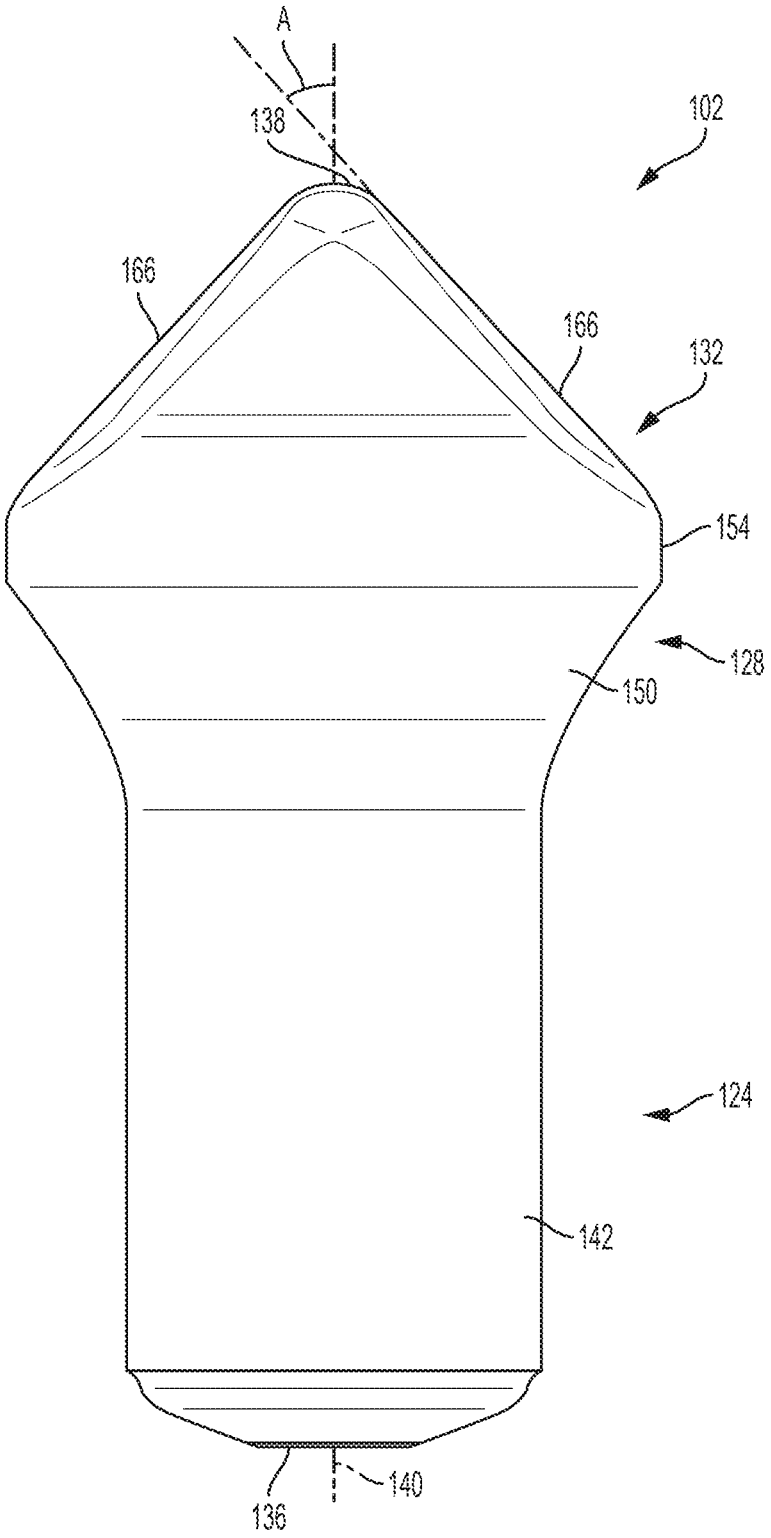
FIG. 7 is the first side view of the cutting bit of FIG. 5.
Figure 8:
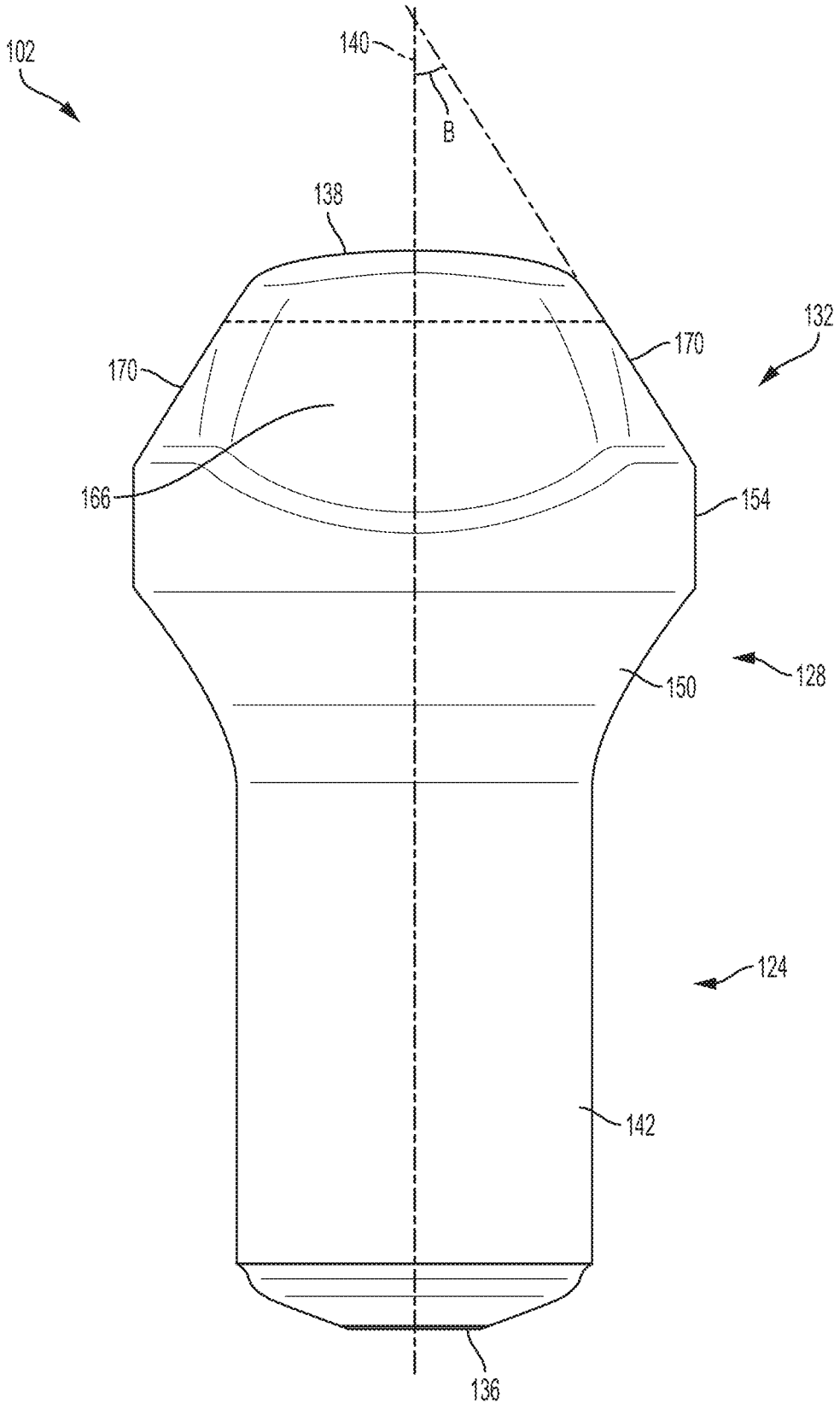
FIG. 8 is a second side view of the cutting bit of FIG. 5.
Figure 9:
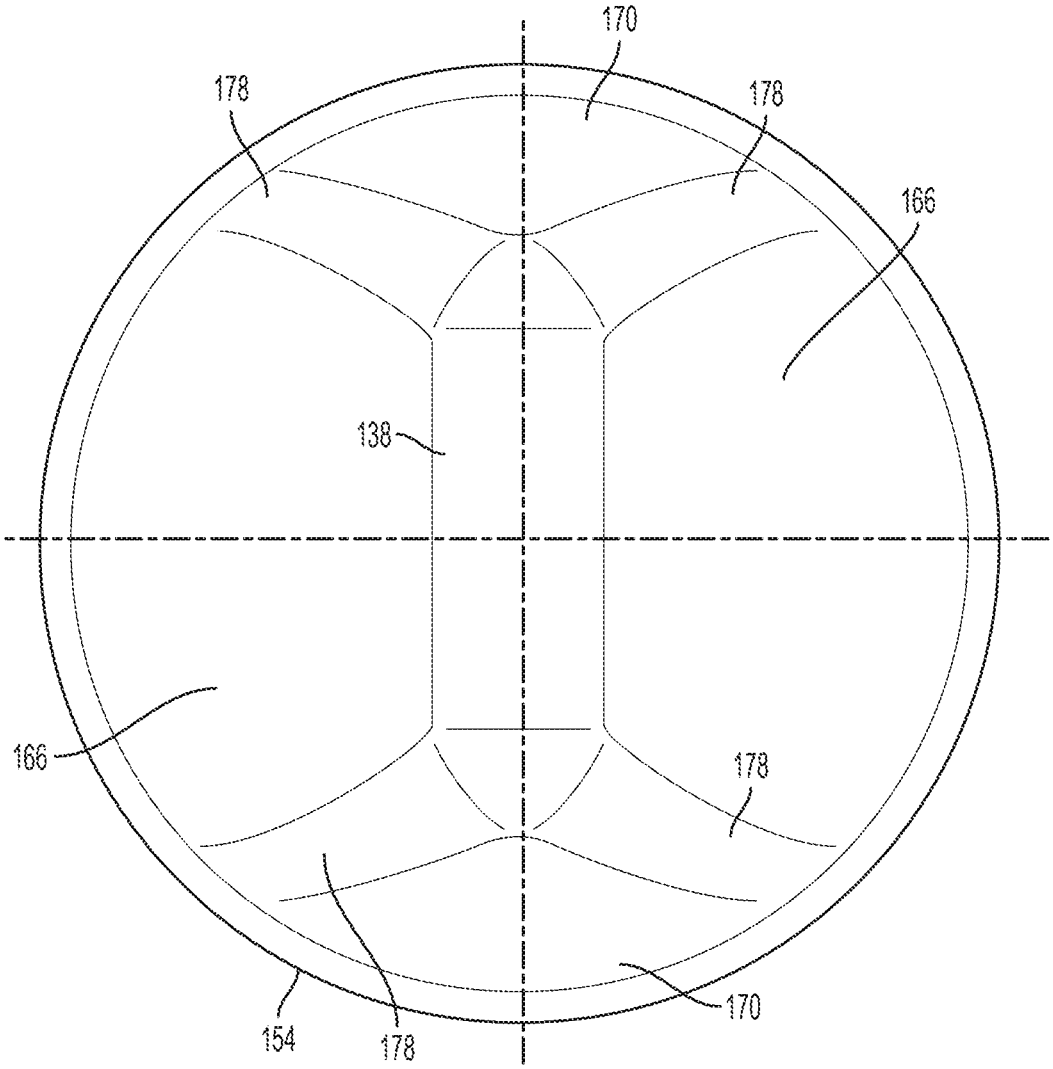
FIG. 9 is a plan view of the cutting bit of FIG. 5.

Referring now to FIGS. 7-9, in the illustrated embodiment, the cutting portion 132 includes a chisel shape. That is, the cutting portion 132 includes a pair of major chisel surfaces 166 extending from the shoulder 154 to the cutting edge 138. The major chisel surfaces 166 are angled relative to each other and each major surface 166 forms an angle A relative to the longitudinal axis 140. In some embodiments, the angle A is between approximately 37 degrees and approximately 48 degrees. In some embodiments, the angle A is approximately 42 degrees. As shown in FIG. 8, the cutting portion 132 also includes a pair of minor surfaces 170 extending from the shoulder 154 to the cutting edge 138 on either side of the major chisel surfaces 166. The minor surfaces 170 are angled relative to each other, and each minor surface 170 forms an angle B relative to the longitudinal axis 140. In some embodiments, the angle B is between approximately 27 degrees and approximately 38 degrees. In some embodiments, the angle B is approximately 33 degrees. A transition between the major chisel surfaces 154 and the minor surfaces 170 may include a rounded or chamfered surface 178 (FIG. 9). In other embodiments, the cutting portion may have a different geometry (e.g., conical, parabolic, ballistic, etc.).

Figure 10:
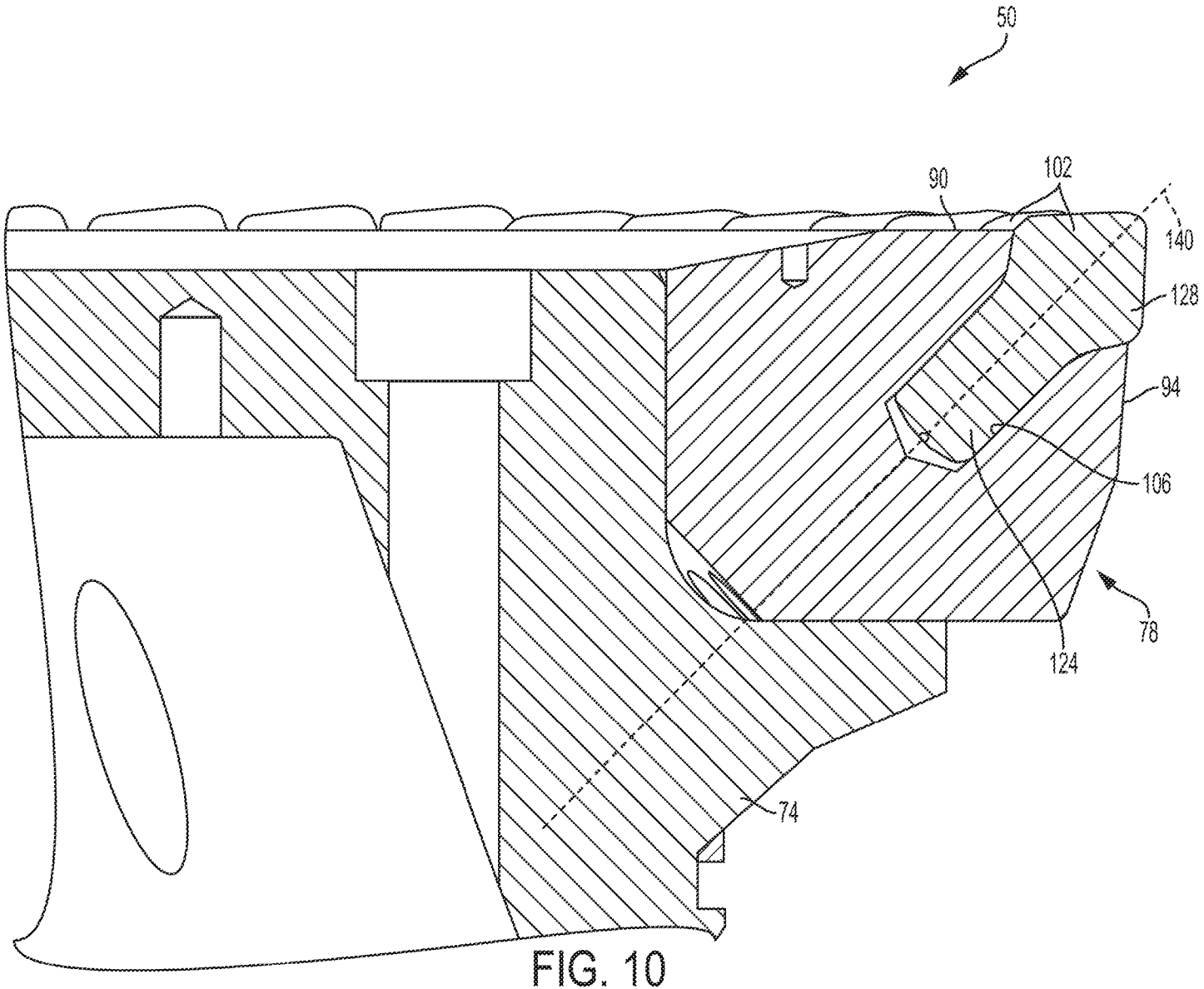
FIG. 10 is a cross-sectional view of the cutting disc of FIG. 3 viewed along section 10-10.

As shown in FIG. 10, each cutting bit 102 is received within an associated bore 106 of the peripheral edge 54. In the illustrated embodiment, the base portion 124 and the transition portion 128 are received within the tapered bore 106. The longitudinal axis 140 of the bit 102 may be oriented at an acute angle relative to the axis of rotation 66 (FIG. 2) and/or relative to the end surface 90 of the cutting ring 78. The cutting edges 138 of the cutting bits 102 may be positioned within a cutting plane.

Figure 11:
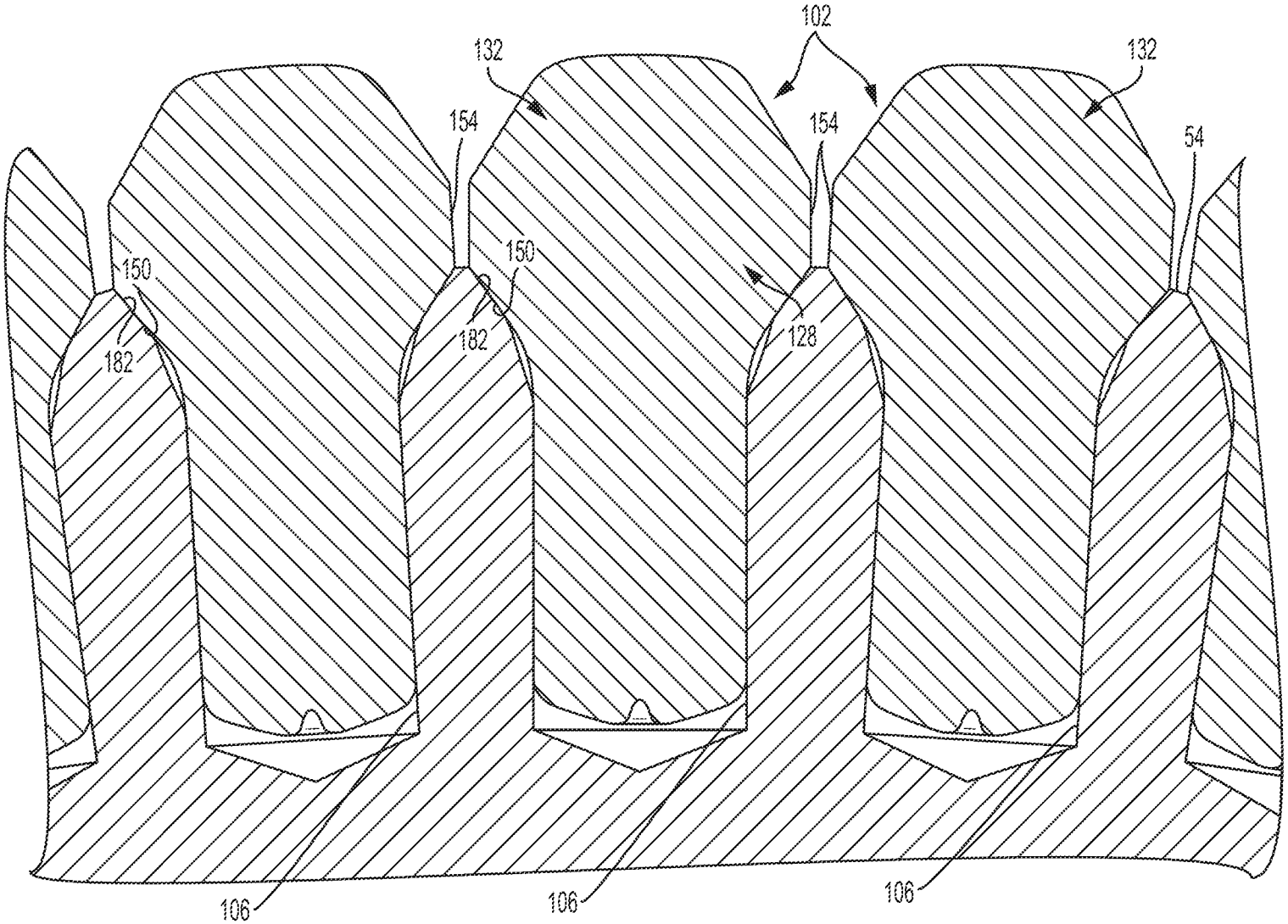
FIG. 11 is a cross-sectional view of the portion of the cutting disc of FIG. 4, viewed along section 11-11.

As shown in FIG. 11, in the illustrated embodiment, the inclined surface 150 of the transition portion 128 engages a corresponding tapered portion or countersink 182 in the tapered bore 106, while the shoulder 154 and cutting portion 132 protrude from the bore 106 above the surface of the disc 50. The cutting portions 132 of the bits 102 engage a rock face (not shown) during operation of the cutting head 22. The engagement of the transition portion 128 and the countersink 182 provides a large surface area for distributing reaction loads exerted on the bits 102 and reducing bending stresses experienced by the bits 162.

As shown in FIG. 11, the cutting bits 102 are received within the bores 106 of the cutting disc 50. The tapered geometry of the cutting bits 102 and the bores 106 reduces the necessary space needed between the cutting portions 132 of adjacent bits 102, permitting adjacent bits 102 to be positioned close to one another and providing a high density of cutting bits 102 per unit of surface area along the peripheral edge 54 of the cutting disc 50. The geometry also decreases the bending stresses on the cutting bits 102 to increase durability. In addition, the geometry of the bits 102 increases the surface area of the cutting portions 132 that engages the rock face during operation.

Figure 12:
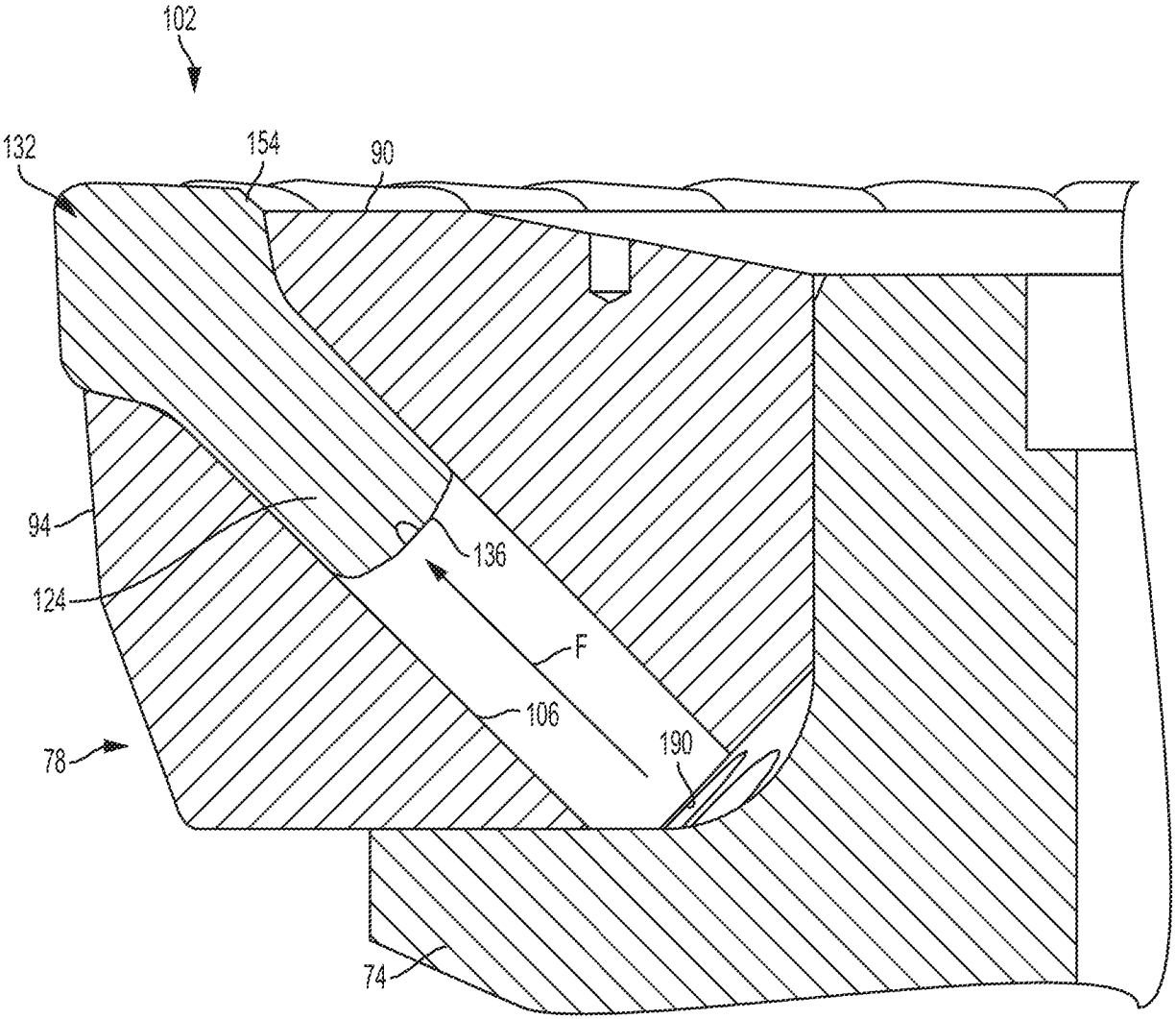
FIG. 12 is a cross-sectional view of a cutting disc according to another embodiment.
Figure 13:
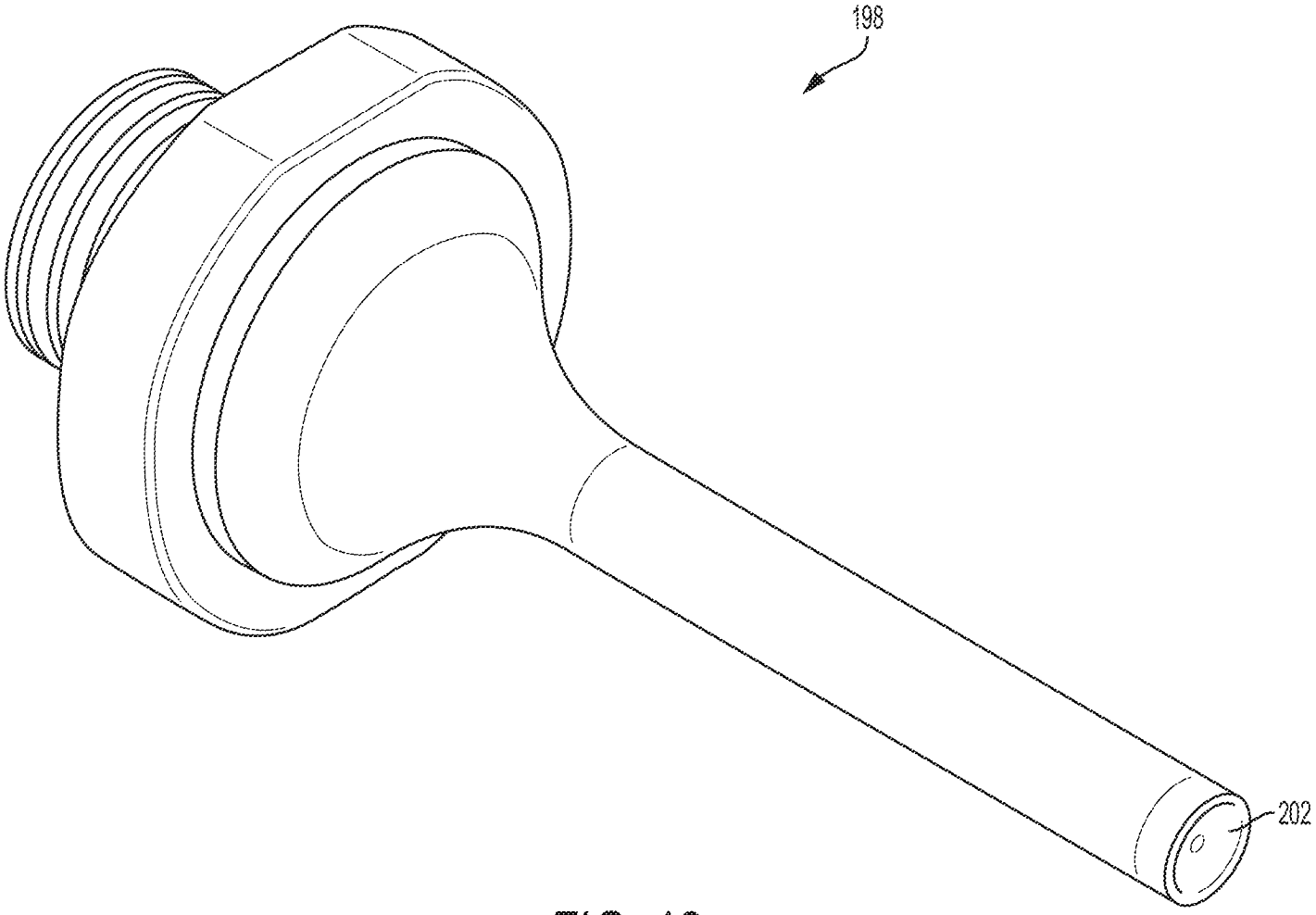
FIG. 13 is a perspective view of a bit removal tool.

Referring now to FIG. 12, in some embodiments the bores 106 extend through the cutting ring 78, and a removal opening 190 is positioned adjacent a rear surface of the cutting ring 78. The removal opening 190 is in communication with the bore 106. A force F may be applied to the base end 136 of the bit 102 through the removal opening 190 to urge the cutting bit 102 out of the bore 106. This force F may be a hydraulic force, a mechanical force, pneumatic force, or any other suitable force to remove the cutting bit 102. For example, a tool 198 (FIG. 13) may include an end 202 that is inserted through the removal opening 190 to contact the base end 136 of the cutting bit 102. The tool 198 may be actuated by a hydraulic press to remove the cutting bit 102. The bits 102 may be removed from the cutting ring 78, allowing a user to replace individual bits 102 that are damaged or worn.

Although certain aspects have been described in detail with reference to certain embodiments, variations and modifications exist within the scope and spirit of one or more independent aspects as described. Various features and advantages are set forth in the following claims.

What is claimed is:

1. A cutting device for engaging a rock face, the cutting device comprising:

a disc supported for rotation about an axis of rotation, the disc including a peripheral edge extending around the axis of rotation, the peripheral edge including a plurality of bores spaced apart along the peripheral edge of the disc, each of the plurality of bores including a countersink opening; and a plurality of cutting elements, each of the cutting elements including a base portion, a cutting portion including a cutting edge, and a transition portion including a tapered surface positioned between the base portion and the cutting portion, the plurality of cutting elements received within the plurality of bores, the tapered surfaces of the plurality of cutting elements engaging the countersink openings of the plurality of bores to distribute loads exerted on the cutting portions across a periphery of the countersink openings, the cutting edge extending at least partially across a width of the cutting portion.

2. The cutting device of claim 1, wherein the peripheral edge is formed at a junction between an end surface of the disc and a peripheral surface of the disc extending around the axis of rotation, the peripheral edge having a circular profile.

3. The cutting device of claim 1, wherein a width of the transition portion proximate the cutting portion is larger than a width of the transition portion proximate the base portion.

4. The cutting device of claim 1, wherein the disc includes a main support and a ring secured to the main support, the ring including the peripheral edge, the ring including a plurality of sections removably coupled to the main support, each section supporting at least one of the cutting elements.

5. The cutting device of claim 1, wherein each bore is in communication with a removal opening for receiving a tool to apply a force on the base portion and remove the associated one of the cutting elements from the cutting disc.

6. The cutting device of claim 1, wherein the base portion has a circular cross-section defining a first diameter and the cutting portion includes a shoulder having a circular profile defining a second diameter larger than the first diameter.

7. The cutting device of claim 1, wherein the cutting portion of each cutting element includes a shoulder positioned between the transition portion and the cutting edge, wherein the shoulder protrudes from the disc.

8. The cutting device of claim 1, wherein each cutting portion includes a first planar surface, a second planar surface, a third planar surface, and a fourth planar surface, each of the first, second, third, and fourth surfaces extending between a shoulder and the cutting edge, each of the first and third surfaces oriented at a first angle relative to a longitudinal axis of the cutting element, each of the second and fourth surfaces oriented at a second angle different than the first angle relative to the longitudinal axis of the cutting element, the first planar surface coupled to the second planar surface by a first rounded surface, the second planar surface coupled to the third planar surface by a second rounded surface, the third planar surface coupled to the fourth planar surface by a third rounded surface, and the fourth planar surface coupled to the first planar surface by a fourth rounded surface.

9. The cutting device of claim 1, wherein each of the plurality of cutting elements includes a longitudinal axis extending through the cutting edge.

10. The cutting device of claim 9, wherein the plurality of cutting elements are positioned in a cutting plane that is spaced from the disc.

11. A cutting head for a mining machine, the cutting head comprising:

a boom configured to be supported on a frame;

a drive mechanism; and a cutting device supported on the boom and driven by the drive mechanism, the cutting device including a disc supported for rotation about an axis of rotation, the disc including a peripheral edge extending around the axis of rotation, the peripheral edge including a plurality of bores spaced apart along the peripheral edge of the disc, each of the plurality of bores including a countersink opening, and a plurality of cutting elements, each of the cutting elements including a base portion, a cutting portion including a cutting edge, and a transition portion including a tapered surface positioned between the base portion and the cutting portion, the plurality of cutting elements received within the plurality of bores, the tapered surfaces of the plurality of cutting elements engaging the countersink openings of the plurality of bores to distribute loads exerted on the cutting portions across a periphery of the countersink openings, the cutting edge extending at least partially across a width of the cutting portion.

12. The cutting head of claim 11, wherein the peripheral edge is formed at a junction between an end surface of the disc and a peripheral surface of the disc extending around the axis of rotation, the peripheral edge having a circular profile.

13. The cutting head of claim 11, wherein a width of the transition portion proximate the cutting portion is larger than a width of the transition portion proximate the base portion.

14. The cutting head of claim 11, wherein the disc includes a main support and a ring secured to the main support, the ring including the peripheral edge, the ring including a plurality of sections removably coupled to the main support, each section supporting at least one of the cutting elements.

15. The cutting head of claim 11, wherein each bore is in communication with a removal opening for receiving a tool to apply a force on the base portion and remove the associated one of the cutting elements from the cutting disc.

16. The cutting head of claim 11, wherein the base portion has a circular cross-section defining a first diameter and the cutting portion includes a shoulder having a circular profile defining a second diameter larger than the first diameter.

17. The cutting head of claim 11, wherein the cutting portion includes a shoulder positioned between the transition portion and the cutting edge, wherein the shoulder protrudes from the disc.

18. The cutting head of claim 11, wherein each cutting portion includes a first planar surface, a second planar surface, a third planar surface, and a fourth planar surface, each of the first, second, third, and fourth surfaces extending between a shoulder and the cutting edge, each of the first and third surfaces oriented at a first angle relative to a longitudinal axis of the cutting element, each of the second and fourth surfaces oriented at a second angle different than the first angle relative to the longitudinal axis of the cutting element, the first planar surface coupled to the second planar surface by a first rounded surface, the second planar surface coupled to the third planar surface by a second rounded surface, the third planar surface coupled to the fourth planar surface by a third rounded surface, and the fourth planar surface coupled to the first planar surface by a fourth rounded surface.

19. The cutting head of claim 11, wherein each of the plurality of cutting elements includes a longitudinal axis extending through the cutting edge.

20. The cutting head of claim 19, wherein the plurality of cutting elements are positioned in a cutting plane that is spaced from the disc.

21. A cutting device for engaging a rock face, the cutting device comprising:

a disc supported for rotation about an axis of rotation, the disc including a peripheral edge extending around the axis of rotation, the peripheral edge including a plurality of bores spaced apart along the peripheral edge of the disc, each of the plurality of bores including a countersink opening; and a plurality of cutting elements each of the cutting elements including a base portion, a cutting portion including a cutting edge, and a transition portion including a tapered surface positioned between the base portion and the cutting portion, the plurality of cutting elements received within the plurality of bores, the tapered surfaces of the plurality of cutting elements engaging the countersink openings of the plurality of bores to distribute loads exerted on the cutting portions across a periphery of the countersink openings, wherein each cutting portion includes a first planar surface, a second planar surface, a third planar surface, and a fourth planar surface, each of the first planar surface, second planar surface, third planar surface, and fourth planar surface extending between a shoulder and the cutting edge, each of the first planar surface and third planar surface oriented at a first angle relative to a longitudinal axis of the cutting element, and each of the second planar surface and fourth planar surface oriented at a second angle different than the first angle relative to the longitudinal axis of the cutting element.

22. The cutting device of claim 21, wherein a first rounded surface is positioned between the first planar surface and the second planar surface, wherein a second rounded surface is positioned between the second planar surface and the third planar surface, wherein a third rounded surface is positioned between the third planer surface and the fourth planar surface, and wherein a fourth rounded surface is positioned between the fourth planar surface and the first planar surface.

* * * * *